US005588865A

United States Patent [19]

Yamamoto

[11] Patent Number: 5,588,865

[45] Date of Patent: Dec. 31, 1996

[54] CONNECTOR FASTENING MECHANISM

[75] Inventor: Masayuki Yamamoto, Shizuoka, Japan

[73] Assignee: Yazaki Corporation, Tokyo, Japan

[21] Appl. No.: 292,776

[22] Filed: Aug. 18, 1994

[30] Foreign Application Priority Data

Aug. 20, 1993 [JP] Japan ..... 5-226702

[51] Int. Cl.[6] ..... H01R 13/627

[52] U.S. Cl. ..... 439/364; 439/352

[58] Field of Search ..... 439/595, 350–358, 439/362–364, 152, 153

[56] References Cited

U.S. PATENT DOCUMENTS 4,627,759 12/1986 Kato et al. .

5,376,016 12/1994 Inaba et al. ..... 439/357

FOREIGN PATENT DOCUMENTS 0420255 4/1991 European Pat. Off. ..... 439/350

62-160471 10/1987 Japan .

3-127783 12/1991 Japan .

2248349 4/1992 United Kingdom ..... 439/350

*Primary Examiner*—David L. Pirlot

*Attorney, Agent, or Firm*—Finnegan, Henderson, Farabow, Garrett & Dunner, L.L.P.

[57] ABSTRACT

A connector fastening mechanism is a mechanism which fastens a male connector to a female connector fittable with the male connector by means of a bolt. In the connector fastening mechanism, two or more projection portions are provided on the outer surface of a housing extending in the longitudinal direction of the male connector, engaging projection portions are provided in the two longitudinal end portions of the male connector, and securing portions corresponding to the projection portions and elastic arm portions elastically contactable with the engaging projection portions for pressing against the male connector in a direction to part it away from the female connector are provided in a U-shaped housing of the female connector.

6 Claims, 2 Drawing Sheets

CONNECTOR FASTENING MECHANISM

BACKGROUND OF THE INVENTION

1. Field of the Invention

The present invention relates to a connector fastening mechanism for fastening male and female connectors together and, in more particular, to a fastening mechanism for fastening together a high density multiple electrode connector having a structure in which a plurality of small multiple electrode connectors are gathered together.

2. Related Art

Conventionally, for example, a connector, in particular, a multiple electrode connector used to connect a wire harness becomes more difficult to connect with some reasonable force as the number of wires to be connected increases. To cope with this, there is provided a so called threadable fastening connector in which a bolt is interposed between male and female connectors to be connected together, and the male and female connectors can be fitted with each other by rotating the bolt.

However, in the above connector fastening mechanism using a bolt, while the male or female connector is held by one hand, the bolt is rotated by the other hand, which results in a poor working efficiency. In view of this, there is proposed a provisional securing mechanism in Examined Japanese Utility Model Publication Sho. 63-16149. In this provisional securing mechanism, a bolt is provided in one connector housing, a nut is provided in the other connector housing, for example, a projection portion is provided in the outer periphery of a male connector, and a securing portion engageable with the projection portion is provided in the inner periphery of a female connector. In fitting the male and female connectors with each other, the projection portion of the male connector is engaged with the securing portion of the female connector to thereby connect the male and female connectors together provisionally, and then the bolt is rotated to thereby fit and fasten the male and female connectors to each other completely.

However, in the above-mentioned provisional securing mechanism, since the male and female connector housings are loosely connected with each other, for example, if a force is given to the connectors in the longitudinal direction thereof, then one of the connectors is caused to incline. In this state, if the bolt is tightened, then the bolt and nut can bite each other so that they cannot be fitted with each other.

SUMMARY OF THE INVENTION

Accordingly, it is an object of the invention to provide a connector fastening mechanism which, even if an external force is applied to a pair of male and female connectors carelessly, is able to support them without inclining one of them and also to prevent a biting phenomenon occurring when a bolt is tightened.

There is provided a connector fastening mechanism which fastens together a male connector and a female connector to be fitted with the male connector by means of a bolt, in which, on the fitting outer peripheral surface of a housing of the male connector extending along the longitudinal direction of the male connector, there are provided two or more projection portions, two engaging projection portions are respectively provided in the two longitudinal end portions of the male connector housing, two securing portions respectively to be engaged with the projection portions are formed on the inner peripheral surface of a housing of the female connector to be fitted with the male connector, and on the two longitudinal end portions of the female connector there are provided two elastic arm portions which, while the two projection portions are respectively engaged with the two securing portions contact elastically the two engaging projection portions to thereby push the male connector in a direction to separate it away from female connector.

In the connector fastening mechanism having the above structure, the male connector is mounted onto the female connector to thereby engage the projection portions of the male connector with the securing portions of the female connector, so that the male connector is secured to the female connector provisionally. In this operation, the engaging projection portions of the male connector push open the elastic arm portions of the female connector and thus the engaging projection portions are elastically held by and between the elastic arm portions, so that the male connector is always given a force in a direction to remove it from the female connector. As a result of this, the provisional securing state between the projection portions and securing portions is always maintained in a state of tension, and the male connector is held horizontally (in parallel) on the female connector. In this state, if the bolt mounted at the central position of the male connector is tightened, then the engaging projection portions are stored between the elastic arm portions and are lowered down, so that the male and female connectors can be fitted with each other without being removed from each other.

DETAILED DESCRIPTION OF THE PREFERRED EMBODIMENTS

Now, description will be given below in detail of an embodiment of a connector fastening mechanism according to the invention with reference to the accompanying drawings.

Figure 1:
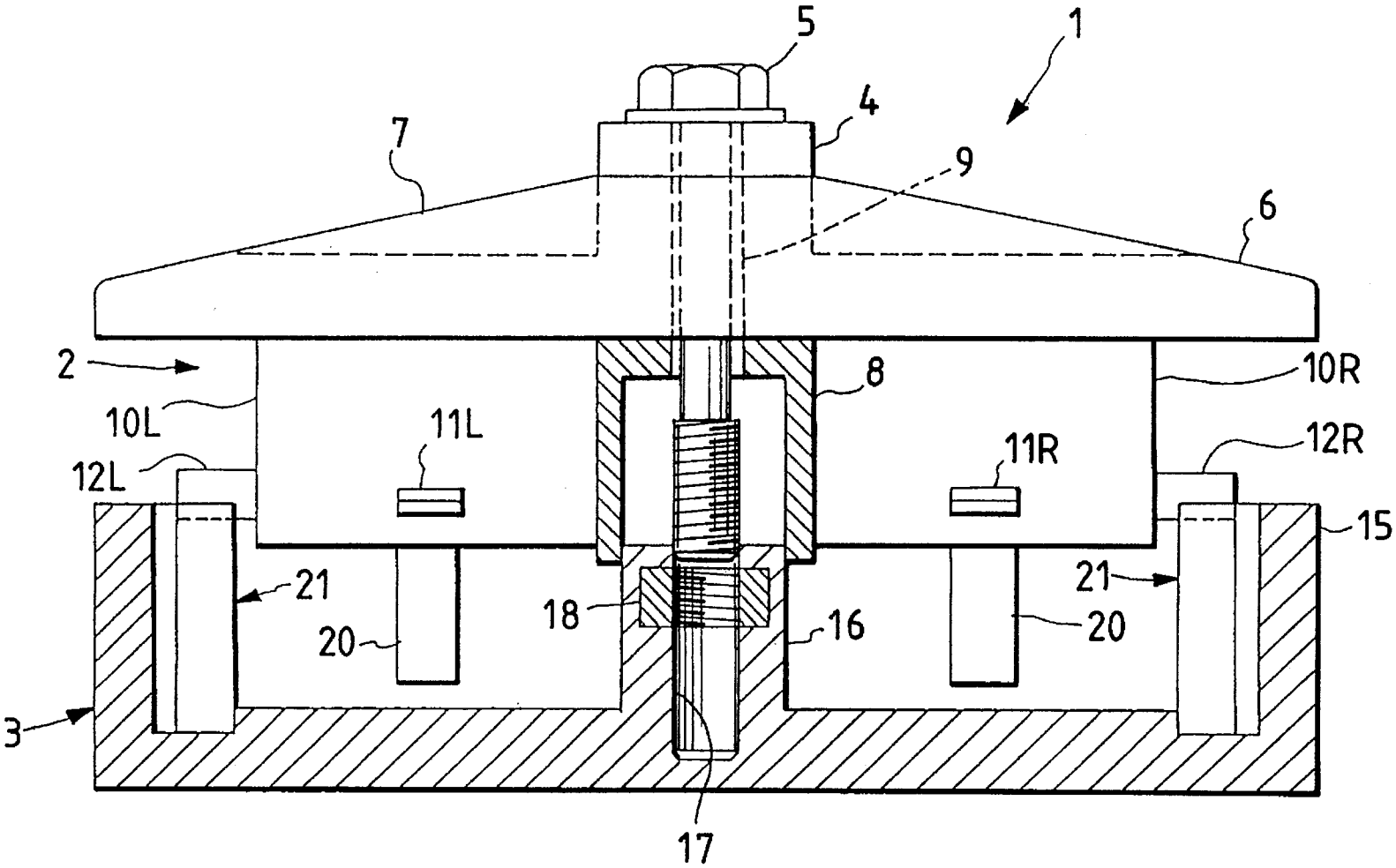
FIG. 1 is a partially sectional front view of an embodiment of a connector according to the invention.
Figure 2:
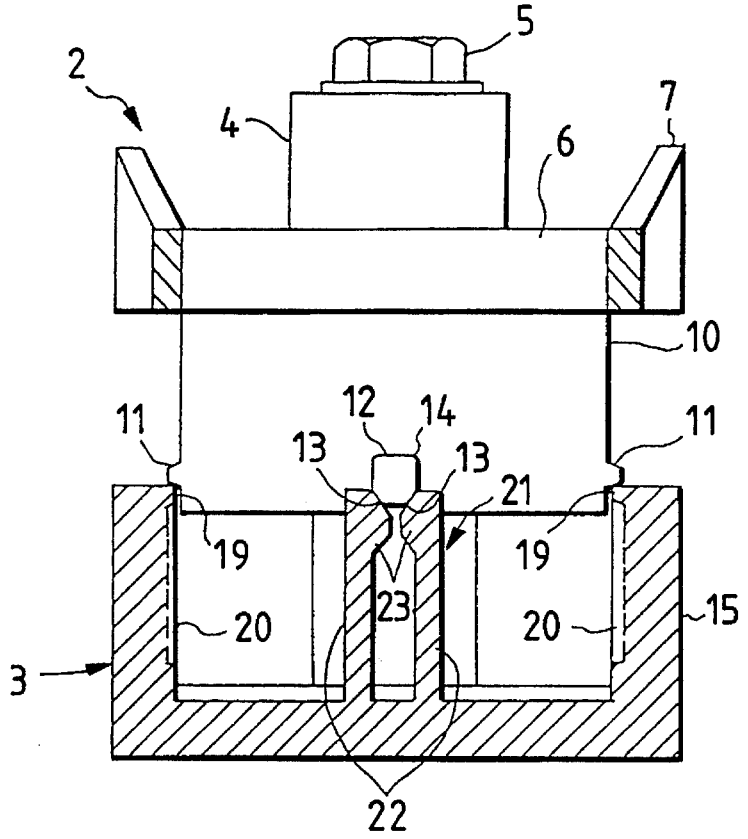
FIG. 2 is a partially sectional side view of the connector shown in FIG. 1.

In FIGS. 1 and 2, a connector 1 consists of a male connector 2 and a female connector 3. The male connector 2 is formed in a rectangular shape and includes a cylindrical boss portion 4 erected upwardly in the central portion thereof. Within the boss portion 4, there is mounted a bolt 5 which is free to rotate and is prevented from axial movement relative thereto. A cover-like frame 6 is provided in the lower portion of the boss portion 5 in such a manner that it is integral with the boss portion 5. In the portions of the cover frame 6 adjacent to the ends thereof extending in the longitudinal direction thereof (in FIG. 1, the front and rear sides), there is provided a reinforcing member 7 which is used to reinforce the flexure of the cover-like frame 6 in the longitudinal direction thereof.

Under the cover-like frame 6, there is provided a cylindrical portion 8 having an outside diameter equal to the boss portion 4, and a bolt hole 9 formed in the boss portion 4 extends into the cylindrical portion 8. Two or more small-size multiple electrode connectors 10 are disposed around the cylindrical portion 8.

Here, two alphabetical letters L and R added to reference characters represent the components that are situated in the left and right sides of the connector, respectively.

On the outer peripheral surfaces of the small-size multiple electrode connectors 10L and 10R extending in the longitudinal direction thereof, there are provided projections 11L and 11R which are respectively used to secure the male connector 2 to the female connector 3 provisionally. The projections 11L and 11R are formed such that they project out in an angular shape from the side walls of the small-size multiple electrode connectors 10L and 10R, and the projections 11L and 11R are engageable with securing portions 19 (which will be described later) to be formed in the female connectors 3.

Also, on the two end portions of the small-size multiple electrode connectors 10L and 10R in the longitudinal direction thereof, there are provided engaging projection portions 12L and 12R which project out outwardly. Each of the engaging projection portions 12L and 12R, as shown in FIG. 2, is formed in such a manner that it provides a substantially square shape when viewed from the front side thereof, the bottom portion thereof provides a sharpened shape with inclined surfaces 13 facing downwardly, and the two sides of the upper end portion thereof provide a relatively large R surface 14. And, the respective parts of the above-mentioned male connector 2, that is, the boss portion 4, cover-like frame 6, reinforcing member 7, cylindrical portion 8, small-size multiple electrode connectors 10, projection portions 11, and engaging projection portions 12 are formed integrally of an insulation member which is formed of synthetic resin.

On the other hand, the female connector 3 comprises a U-shaped housing 15 having an internal dimension that allows storage of the small-size multiple electrode connectors 10L and 10R, and the outer periphery of the U-shaped housing 15 is formed in an insulation member which is formed of synthetic resin and provides a surface equal to the outer wall surface of the male connector consisting of the cover-like frame 6 and reinforcing member 7. Within the U-shaped housing 15, there is provided integrally therewith a cylindrical pedestal 16 which is to be stored closely into the cylindrical portion 8. In the central portion of the cylindrical pedestal 16, there is formed a bolt hole 17 into which the threaded shaft of the bolt 5 is to be inserted, and, in the upper portion of the bolt hole 17, there is molded a nut 18 to be threadedly connected with the bolt 5.

At the positions of the inner peripheral surface of the female connector 3 corresponding to the projection portions 11L and 11R provided in the male connector 2, there are formed securing portions 19. And, guide grooves 20 are formed under the securing portions 19 in such a manner that they extend from the securing portions 19, respectively. If the projection portions 11L and 11R of the male connector 2 disposed above the securing portions 19 exceed the securing portions 19, then the projection portions 11L and 11R respectively move into the guide grooves 20 and are then guided downwardly through the female connector 3.

Also, in the vicinity of either end portion of the female connector 3 extending internally and longitudinally of the female connector 3, as shown in FIG. 2, there is provided an elastic arm portion 21 which is used to hold the engaging projections 12 of the male connector 2 therebetween. The elastic arm portion 21 comprises a pair of arm members 22 which are respectively erected perpendicularly from the bottom surface of the U-shaped housing 15 at positions spaced apart from the outer wall of the U-shaped housing 15. A space between the pair of arm members 22 is formed slightly narrower than the transverse width of the engaging projection portion 12, so that the engaging projection portion 12 can be held elastically in the space.

The elastic arm portion 21 includes a slitted head portion, that is, it includes mutually opposing inner surfaces projecting toward each other, and in the upper end portion thereof a head portion 23 which has inclined surfaces corresponding to the inclined surfaces 13 of the engaging projections 12.

Figure 3:
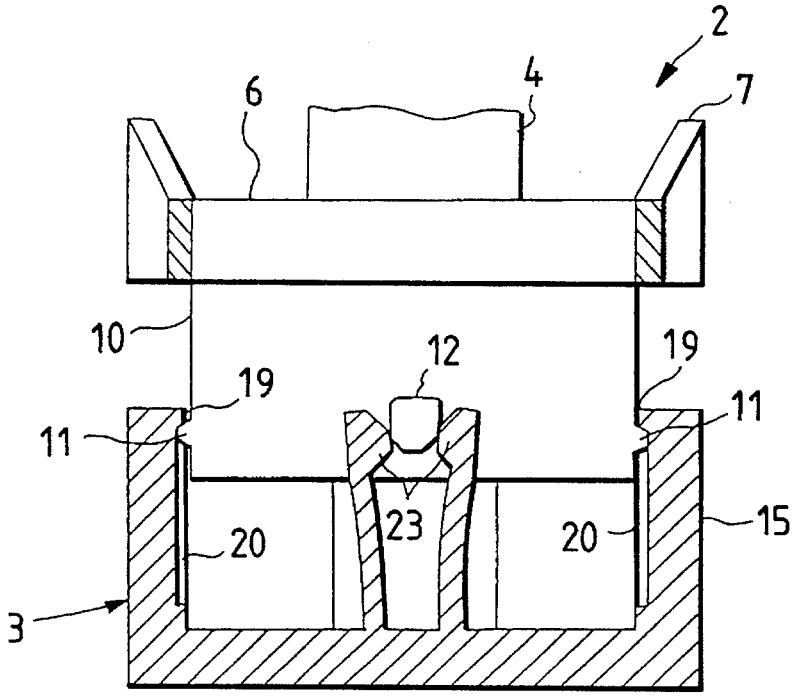
FIG. 3 is a partially sectional side view of a fastening state of the connector shown in FIG. 2.

When fitting the male connector 2 and female connector 3 with each other, after the engaging projections 12 are placed on the inclined surfaces of the head portion 23 of the elastic arm portion 21 in such a manner that the same inclined surfaces coincide with the inclined surfaces 13, the male connector 2 is slightly inserted toward the female connector 3 in such a manner that, as shown in FIG. 3, the projection portions 11 are pressed into the lower surfaces of the securing portions 19 of the U-shaped housing 15. This secures the male connector 2 to the female connector 3 provisionally.

In the provisionally secured state, male and female terminals respectively stored in the male and female terminals still remain uncontacted with each other. In this state, the engaging projection portions 12 are slightly lowered down to push the elastic arm portion 21 open right and left, whereby the engaging projection portions 12 are elastically held by and between the slitted head portion 23 of the arm portion 21. Due to the elastic contact of the head portion 23, the engaging projection portions 12 are energized upwardly and the male connector 2 is pushed in a direction to part away from the female connector 3. On the other hand, since the projection portions 11 are in engagement with the securing portions 19, the provisionally secured state between the projection portions 11 and securing portions is always kept in a state of tension, so that the male connector 2 is supported on the female connector 3 while it is always kept in a horizontal direction.

Next, if the bolt 5 mounted in the male connector 2 is threadedly engaged with the nut 18 of the female connector 3, then the male and female connectors 2 and 3 can be connected with each other. However, in the provisionally secured state, as shown in FIG. 1, since the bolt leading end is not yet in contact with the nut 18, when tightening the bolt, while the bolt head portion is being pressed down against the nut 18 by use of an impact (torque) wrench, the bolt 5 is tightened. That is, by tightening the bolt 5 with the bolt leading end pressed against the nut 18, the male connector 2 is fitted into the female connector 3. And, the projection portions 11 are respectively lowered down between the arm members 22 of the elastic arm portions 21 to thereby fit the male connector 2 into the female connector 3 completely without being shifted or curved, so that the connector 1 can be reasonably made to conduct electrically.

If the bolt 5 is rotated in its loosening direction and is thus removed from the nut 18, then the connection between the cover-like frame 6 and housing 15 can be easily removed.

As has been described heretofore, in a connector according to the invention, two or more projection portions are provided on the housing surface of a male connector extending along the longitudinal direction of the male connector, engaging projection portions are respectively provided in the two longitudinal end portions of the male connector, securing portions to be engaged with the projection portions and elastic arm portions elastically contactable with the engaging projection portions for pressing the male connector against the female connector to thereby hold the engaging projection portions therebetween are formed on the housing inner peripheral surface of the female connector, the projection portions of the male connector are provisionally secured to the securing portions of the female connector to thereby support the male connector in a horizontal direction, and a bolt is tightened to thereby hold and fit the engaging projection portions with the securing portions, so that the connector can be fastened together in such a manner that it is always supported in a horizontal direction.

What is claimed is:

1. A connector fastening mechanism comprising:

a male connector and a female connector fittable with each other by a fastening member in one of a provisional engagement state and a complete engagement state;

engaging means for retaining the male and female connectors against separation in the provisional engagement state; and elastic means for pressing one of the male and female connectors in a direction to separate the one connector from the other connector in the provisional engagement state.

2. A connector fastening mechanism as claimed in claim 1, wherein the elastic means includes a projection provided on one connector and an elastic arm provided on the other connector.

3. A connector fastening mechanism comprising:

a male connector and a female connector fittable with each other when aligned on a connection axis by a fastening member at one of a provisional engagement state and a complete engagement state;

provisional engagement state holding means for holding a provisional engagement of the female and male connector, the provisional engagement state holding means including:

engaging means for retaining the male and female connectors against separation in the provisional engagement state; and elastic means for pressing one connector in a direction to separate the one connector from the other connector in the provisional engagement state, said engaging means and said elastic means being symmetrically spaced about the connection axis, thereby to maintain the one connector yieldably biased against the engaging means and aligned with the other connector during the provisional state.

4. A connector fastening mechanism as claimed in claim 3, wherein the elastic means includes a pair of elastic arms on one connector and a retaining member on the other connector, the retaining member abutting against the elastic arms.

5. A connector fastening mechanism as claimed in claim 3, wherein the engaging means includes opposite projections on one connector, and recesses on the other connector and aligned with the projections in an engagement direction.

6. A connector fastening mechanism as claimed in claim 5, wherein the projections are provided on an outer peripheral surface of the one connector, and the recesses engageable with the projection are provided on an inner peripheral surface of the other connector.

* * * * *